US008745777B2

(12) United States Patent
Shteyngarts

(10) Patent No.: US 8,745,777 B2
(45) Date of Patent: Jun. 10, 2014

(54) BATHTUB COVER

(76) Inventor: Gregory A. Shteyngarts, Solon, OH (US)

( * ) Notice: Subject to any disclaimer, the term of this patent is extended or adjusted under 35 U.S.C. 154(b) by 1032 days.

(21) Appl. No.: 12/765,287

(22) Filed: Apr. 22, 2010

(65) Prior Publication Data

US 2010/0269252 A1 Oct. 28, 2010

Related U.S. Application Data

(60) Provisional application No. 61/173,338, filed on Apr. 28, 2009.

(51) Int. Cl.
*A47K 3/02* (2006.01)

(52) U.S. Cl.
USPC ..... 4/580

(58) Field of Classification Search
USPC ..... 4/580, 538, 581–583, 553, 546; 607/81
See application file for complete search history.

(56) References Cited

U.S. PATENT DOCUMENTS 2,853,714 A * 9/1958 Darmstadt ..... 4/580
3,460,167 A * 8/1969 Benjamin ..... 4/580
7,849,528 B1 * 12/2010 Tuday ..... 4/498

* cited by examiner

*Primary Examiner* — Lori Baker
(74) *Attorney, Agent, or Firm* — Tarolli, Sundheim, Covell & Tummino L.L.P.

(57) ABSTRACT

A cover for a bathtub includes a base and wall that extends from the base. The wall defines an interior space and includes a plurality of wall segments. A panel is connected to the wall and closes an end of the interior space. The panel is adapted to engage the bathtub and has a plurality of pockets for protecting the bathtub.

18 Claims, 6 Drawing Sheets

BATHTUB COVER

RELATED APPLICATION

This application claims the benefit of U.S. Provisional Patent Application Ser. No. 61/173,338, filed on Apr. 28, 2009, the disclosure of which is entirely incorporated herein by reference.

TECHNICAL FIELD

The present invention is directed to covers and, in particular, is directed to covers for protecting bathtubs.

BACKGROUND OF THE INVENTION

The exposed finish of the surface of a bathtub is regarded as quite important as far as the ultimate user or purchaser of such a tub is concerned. If the tub finish is damaged, the bathtub becomes less desirable as a bathtub having its original finish and intended appearance intact. Such damage may occur for example, during installation of the bathtub, during renovation or reconstruction of the bathroom in which the bathtub is located or during removal of the bathtub for placement elsewhere. As a result of these considerations, a number of efforts have been made to provide protective covers for bathtubs.

SUMMARY OF THE INVENTION

In accordance with the present invention, a cover for protecting a bathtub includes a base and a plurality of walls that extend from the base. The wall defines an interior space and includes a plurality of wall segments. A panel is connected to the wall and closes an end of the interior space. The panel is adapted to engage the bathtub and has a plurality of pockets for protecting the bathtub.

In accordance with another aspect of the present invention a cover for protecting a bathtub includes a base that extends along a plane and a wall connected to the base and defining an interior space. The wall includes a plurality of expandable wall segments capable of nesting within one another. A panel is connected to the wall and closes an end of the interior space. The panel is adapted to protect the bathtub and has a first position in which the panel extends substantially along the plane when the wall segments are nested and a second position in which the panel is spaced from the plane when at least one of the wall segments is not nested.

The foregoing and other features and advantages of the present invention will become apparent to those skilled in the art to which the present invention relates upon reading the following description with reference to the accompanying drawings.

DETAILED DESCRIPTIONS

The present invention is directed to covers and, in particular, is directed to covers for protecting bathtubs. The cover, when placed in the bathtub, covers portions of the bathtub that otherwise would be exposed. This may be desirable when, for example, construction is being done in the area immediate or adjacent to the bathtub. The cover therefore may protect the bathtub from being damaged from falling debris, errant tool strikes or the construction workers themselves.

Figure 1:
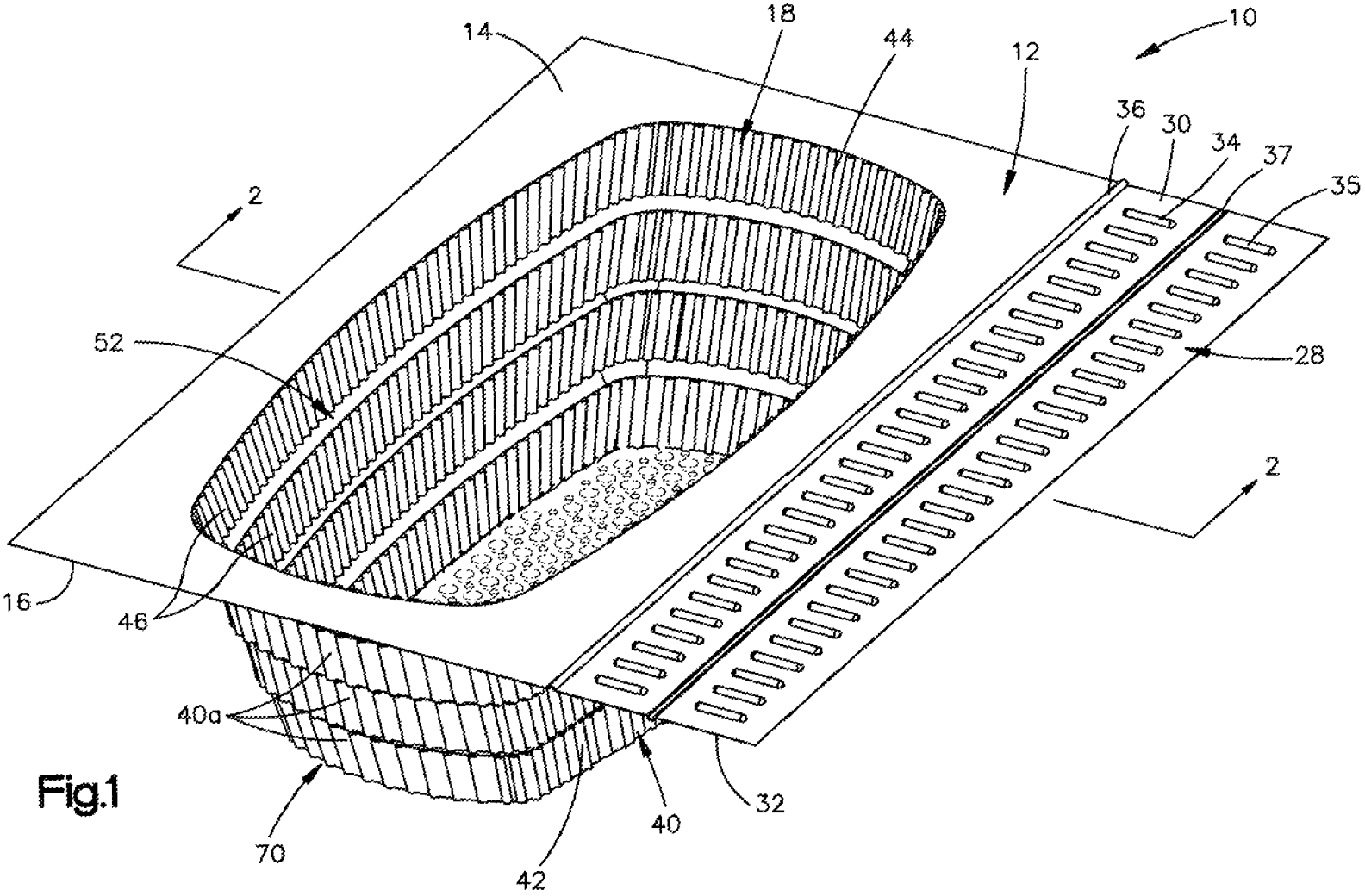
FIG. 1 is a schematic illustration of a bathtub cover in accordance with an embodiment of the present invention.

FIG. 1 illustrates an example of a bathtub cover 10 in accordance with the present invention. The cover 10 may be constructed of any elastically deformable material, such as plastics or polymers. For example, the cover 10 may be constructed of any thermoformable material such as styrene, high impact styrene, polystyrene (PS), rubber modified styrene, high impact polystyrene (HIPS), crystalline high impact polystyrene, polyethylene (PE), low-density polyethylene (LDPE), high-density polyethylene (HDPE) or polymers/blends thereof.

The cover 10 includes a base 12, a wall 40 connected to the base, and a bottom panel 70 connected to the wall. The wall 40 constitutes a plurality of interconnected wall segments 40*a*. The base 12 generally extends along a plane 13 and includes a top surface 14 and a substantially parallel bottom surface 16. Although the base 12 is illustrated as having a rectangular construction, those having ordinary skill will appreciate that the base could have alternative constructions such as, for example, square, circular, triangular, elliptical or otherwise any shape corresponding with a bathtub. An opening 18 is formed in the base 12 and leads to an interior space 52 defined by the base, the wall 40, and the bottom panel 70. The opening 18 may have any shape such as round, elliptical, circular or any polygonal shape.

A flange 28 extends from the base 12 and includes a top surface 30 and a bottom surface 32. Although the flange 28 is illustrated as having a rectangular construction, those having ordinary skill will appreciate that the flange may have any shape corresponding with a portion of a bathtub. The cover 10 includes a line of weakness or reduced material thickness 36 that extends the length of the base 12 and connects the flange 28 to the base. The line of weakness 36 has a material thickness that is less than the thickness of the base 12 and the flange 28. The line of weakness 36 allows the flange 28 to move relative to the base 12 without plastically deforming the base or the flange. The line of weakness 36 may be configured or shaped to promote movement of the flange 28 in one direction relative to the base 12. For example, the line of weakness 36 may have a concave or convex shape to promote downward or upward movement of the flange 28 relative to the base 12, as viewed in FIG. 1.

The flange 28 may also include a line of weakness or reduced material thickness 37 that extends the length of the base 12 in a direction substantially parallel to the line of weakness 36. The line of weakness 37 on the flange 28 has a material thickness that is less than the thickness of the flange and allows the flange to be folded onto itself without plastically deforming. The line of weakness 37 may be configured or shaped to promote movement of the flange 28 in one direction relative to the base 12. For example, the line of weakness 37 may have a concave or convex shape to promote downward or upward movement of the flange 28 relative to the base 12, as viewed in FIG. 1.

While the lines of weakness 36, 37 may promote relative movement of the flange 28 in a particular direction relative to the base 12, it will be understood that the lines of weakness may simultaneously allow for relative movement of the flange in the opposite direction. Alternatively, the lines of weakness 36, 37 may only allow for relative movement of the flange 28 relative to the base 12 in a single direction.

Figure 2:
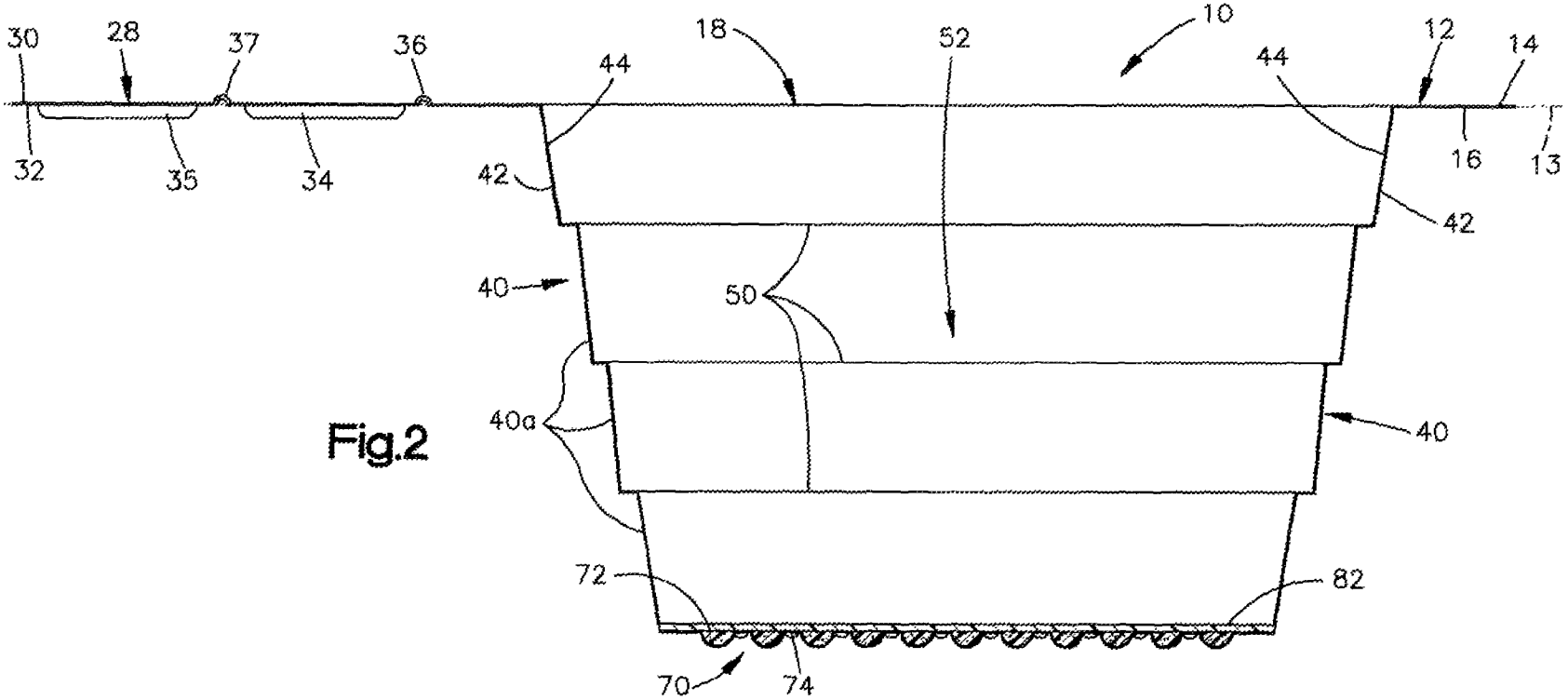
FIG. 2 is a sectional view of the cover taken along line 2-2 in FIG. 1.

A first and second plurality of ribs 34 and 35 are formed in the flange 28 and may extend parallel to the length or the width of the flange. The ribs 34 and 35 are indentations or depressions formed in the base flange 28 that may extend away from the top surface 30 and/or the bottom surface 32 of the flange. FIG. 2 illustrates that the ribs 34 and 35 have a rounded shape, although alternative shapes, such as triangular or square are contemplated. The ribs 34 and 35 may all have the same shape and size or the shape and/or size of the ribs may vary in accordance with the present invention.

As illustrated, the first plurality of ribs 34 extends between the lines of weakness 36 and 37 and the second plurality of ribs 34 extends between the line of weakness 37 and the end of the flange 38 opposite the base 12. Those having ordinary skill will appreciate, however, that the ribs 34 may extend across the line of weakness 37 and along the entire length of the flange 28. Alternatively, the first plurality of ribs 34 may be omitted.

The wall segments 40*a* that make up the wall 40 are connected to the base 12 and extend downward and away from the bottom surface 16 of the base. The wall segments 40*a* have a generally rounded or elliptical shape which corresponds to the shape of the opening of the bathtub. Each of the wall segments 40*a* includes an outer surface 42 and an inner surface 44. A plurality of ribs 46 is formed in the wall segments 40*a* and extends substantially perpendicular to the plane 13 of the base 12. The ribs 46 may extend outward from the outer surface 42 or inward from the inner surface 44 of the wall segments 40*a*. The ribs 46 in the wall segments 40*a* may be similar in construction to the ribs 34 and 35 formed in the flange 28. Although FIGS. 1-2 illustrate ribs 46 having a rounded shape, alternative shapes, such as triangular or square are contemplated. The ribs 46 may all have the same shape and size or the shape and/or size of the ribs may vary in accordance with the present invention.

Although not shown, those having ordinary skill will appreciate that the base 12 may include ribs similar to the ribs 34 and 35 on the flange or the ribs 46 on the wall segments 40*a*. Those skilled in the art will also appreciate that although all the wall segments 40*a* are illustrated as having ribs 46, the ribs may likewise be omitted from one or more of the wall segments, including all of the wall segments.

FIGS. 1-2 illustrate that the wall segments 40*a* have a stepped configuration from the base 12 to the bottom panel 70. In particular, the wall segments 40*a* constitute a series of steps that become closer to one another moving in a direction from the base 12 to the bottom panel 70. In this configuration the wall segments 40*a* are concentric with one another. Each of the steps is separated by lines of weakness or reduced material thickness 50. The combination of the stepped configuration and the lines of weakness 50 allow the wall segments 40*a* and, thus, the wall 40 to expand or collapse relative to the base 12. In other words, the wall segments 40*a* may become nested within one another to decrease the distance between the base 12 and the bottom panel 70. Furthermore, the wall segments 40*a* may have a construction that facilitates expansion and contraction of the wall 40. For example, the wall segments 40*a* may be formed of a thin material having a thickness of about 0.020", although alternative constructions and thicknesses of the wall segments are contemplated.

Figure 3:
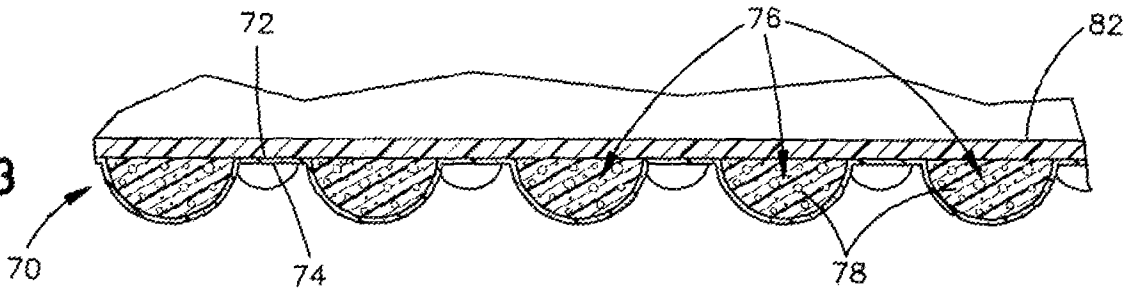
FIG. 3 is an enlarged view of a portion of the cover of FIG. 2.

FIGS. 2-3 illustrate that the bottom panel 70 is connected to the wall 40 and closes one end of the interior space 52 opposite the base 12. The bottom panel 70 includes a top surface 72 and a bottom surface 74 and extends substantially parallel to the plane 13 of the base 12. The bottom panel 70 includes a plurality of pockets 76 that extend away from the top surface 72 and the interior space 52. Although the pockets 76 are illustrated as having a semi-circular shape, it will be appreciated that the pockets could have an alternative shape, such as triangular or rectangular. The pockets 76 may, for example, have a spherical shape in which the pockets extend away from both the top surface 72 and the bottom surface 74 of the bottom panel 70 and are completely enclosed.

The pockets 76 may have a uniform or non-uniform size and may be evenly or unevenly distributed along the bottom panel 70. At least one of the pockets 76 may be filled with a padding material, such as foam 78. Alternatively, the pockets 76 may remain unfilled. Although the pockets 76 are illustrated as being integrally formed with the bottom panel 70, it will be appreciated that the pockets may be formed in a separate sheet (not shown) secured to the bottom panel.

Optionally, the cover 10 may include a seal or liner 82 which is positioned over the bottom panel 70 overlying the pockets 76. The liner 82 is secured to the bottom panel 70 via adhesive, fasteners, heat or the like such that the foam 78 is maintained in the pockets 76 between the bottom panel and the liner 82. If the foam 78 is omitted from the pockets 76, the liner 82 may trap air within the pockets between the bottom panel 70 and the liner. Alternatively, the liner 82 may be omitted. Additionally, the pockets 76 may be omitted and a layer of foam 78 may be provided on the bottom panel 70 with or without the liner 82 (not shown).

Figure 4:
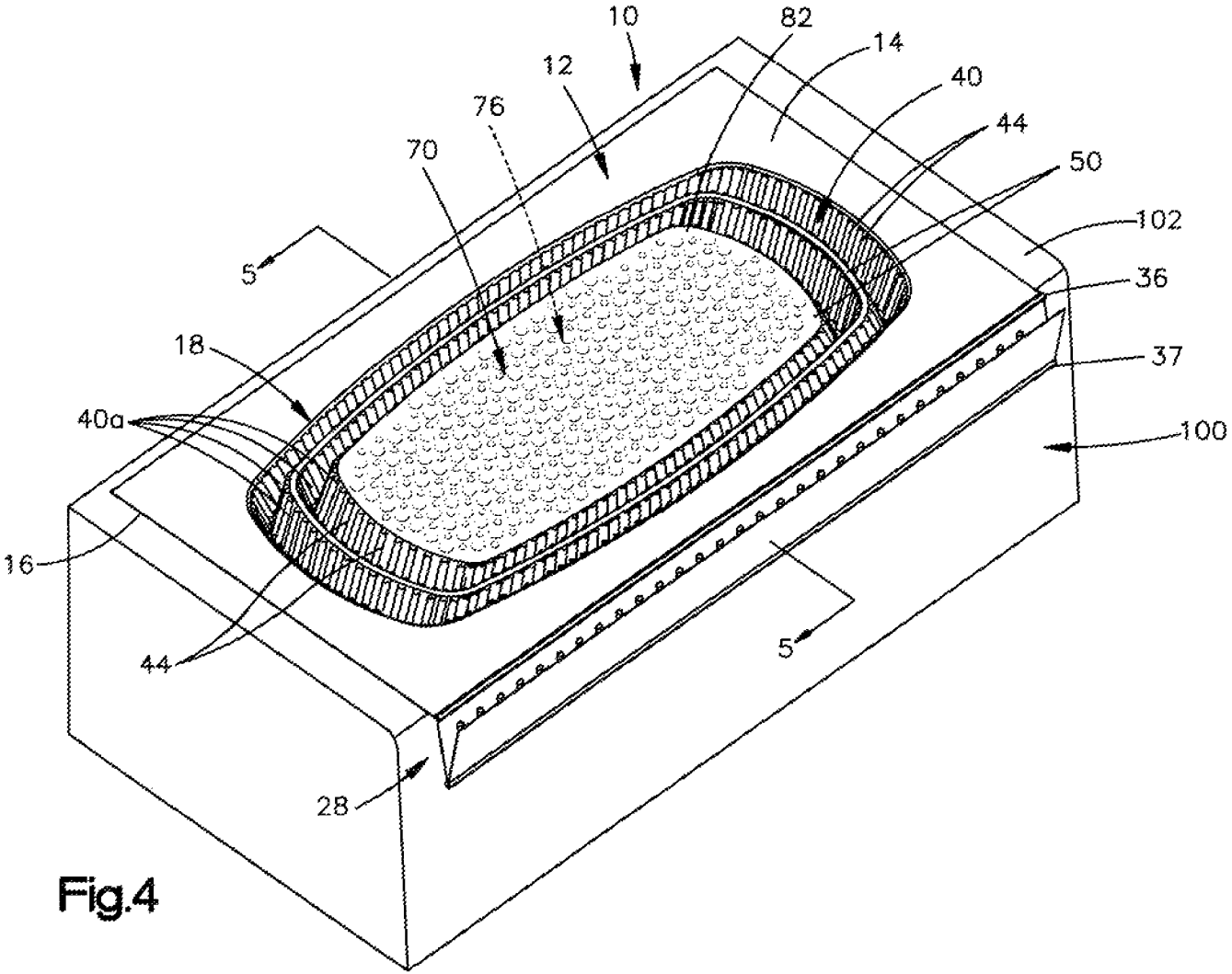
FIG. 4 is a schematic illustration of the cover of FIG. 1 in a collapsed condition.
Figure 5:
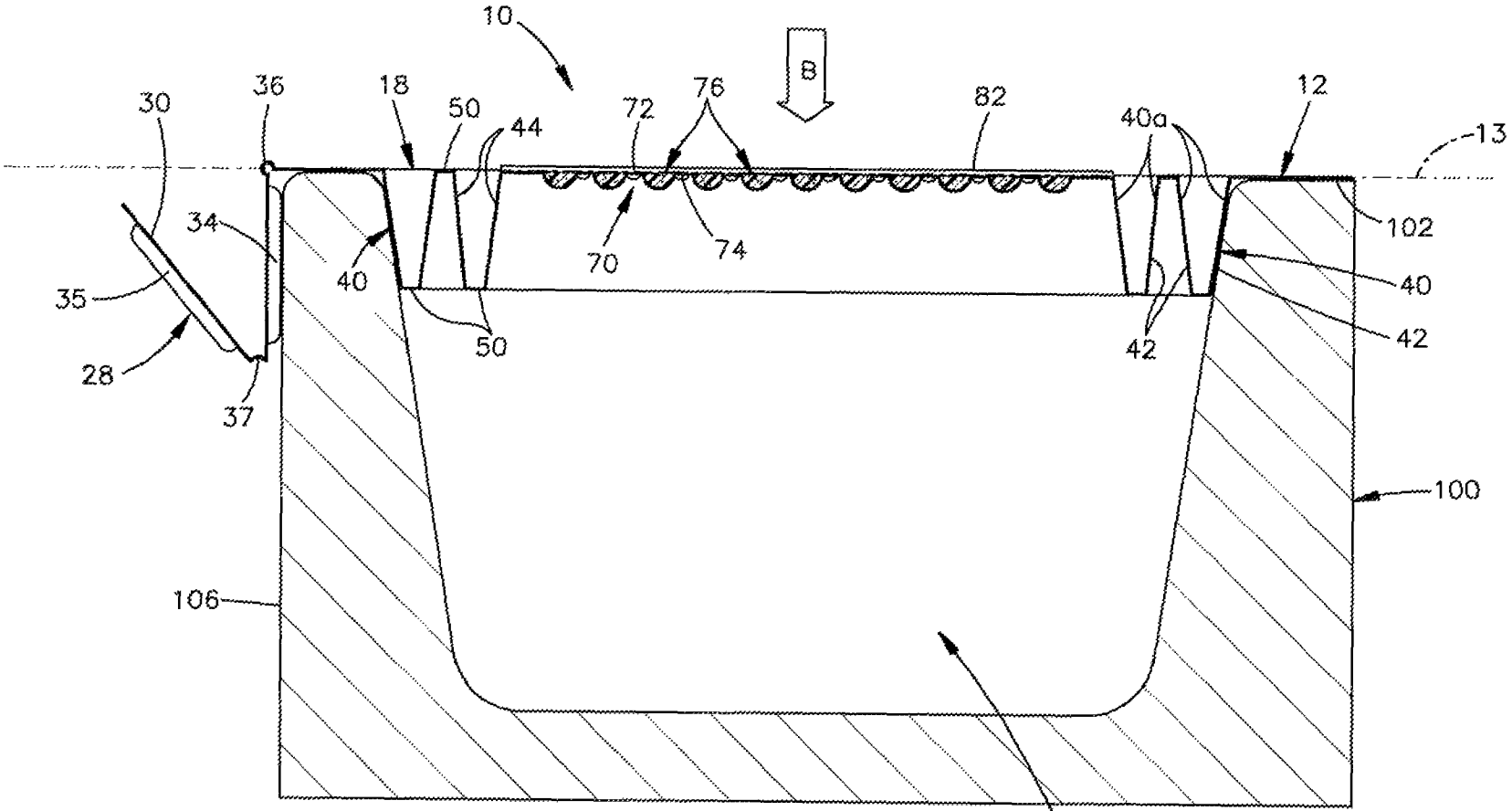
FIG. 5 is a sectional view of the cover taken along line 5-5 of FIG. 4.

Following manufacturing, the cover 10 is provided in a fully collapsed condition (FIGS. 4-5). In particular, the wall segments 40*a* and, thus, the wall 40 has a first condition in which all the steps are collapsed unto themselves, i.e., the wall segments are nested, and the bottom panel 70 is substantially aligned with the plane 13 of the base 12. When the wall 40 is collapsed and the bottom panel 70 is substantially aligned with the plane 13 of the base 12, the interior space 52 of the cover 10 has little or no volume. In the collapsed condition, the flange 28 on the cover 10 is also folded onto itself along the lines of weakness 36, 37.

The collapsed condition of the cover 10 is advantageous for several reasons. In particular, the size of the collapsed cover 10 is substantially smaller than conventional bathtub covers. This reduced size facilitates physical manipulation by the user as well as stacking of multiple covers on to one another for storage, transportation, etc. The reduced size of the collapsed cover also reduces shipping costs and storage space.

In use, the base 12 of the cover 10 is placed on the rim 102 of a bathtub 100 requiring protection. If desired, the bottom surface 16 of the base 12 may be provided with adhesive tape or other fastening means (not shown) to secure the bottom surface to the rim 102 of the bathtub 100. By placing the base 12 on the rim 102 of the bathtub 100, the wall 40 is positioned within the interior space 104 of the bathtub 100.

The cover 10 is then transformed to an expanded condition by expanding the wall 40. In particular, force is applied through the opening 18 in the base 12 and to the bottom panel 70 in a direction indicated by arrow B (FIG. 5). This forces the bottom panel 70 away from the base 12 and toward the bottom surface 108 of the interior space 104 of the bathtub 100. Movement of the bottom panel 70 towards the bottom surface 108 causes the steps of the wall segments 40*a* to un-nest and, thus, causes the wall 40 to expand away from the opening 18 in the base 12, thereby increasing the volume of the interior space 52 of the cover 10. In other words, movement of the bottom panel 70 towards the bottom surface 108 causes one or more of the wall segments 40*a* to become un-nested from one another. The expansion of the wall 40 is facilitated by the stepped construction of the wall segments 40*a* and, in particular, by the lines of weakness 50 provided at each step of the wall.

The cover 10 may be designed such that the wall 40 continues to expand downwards until the wall and, thus, the cover reaches a second, fully expanded, condition. When the wall 40 reaches the fully expanded condition, the bottom panel 70 engages the bottom surface 108 of the bathtub 100 and the interior space 52 of the cover 10 occupies a substantial amount of the interior space 104 of the bathtub 100. Those having ordinary skill, however, will appreciate that the wall segments 40*a* of the cover 10 may be designed such that the wall 40 reaches the fully expanded condition prior to the bottom panel 70 engaging the bottom surface 108 of the bathtub 100 and, thus, the interior space 52 of the cover may not occupy a substantial portion of the interior space 104 of the bathtub. Those having ordinary skill will also appreciate that the wall 40 may not fully expand, i.e., some wall segments 40*a* may remain nested with other wall segments, when the bottom surface 108 of the bathtub 100 is spaced from the rim 102 a distance that is less than the combined height of the wall segments.

Figure 7:
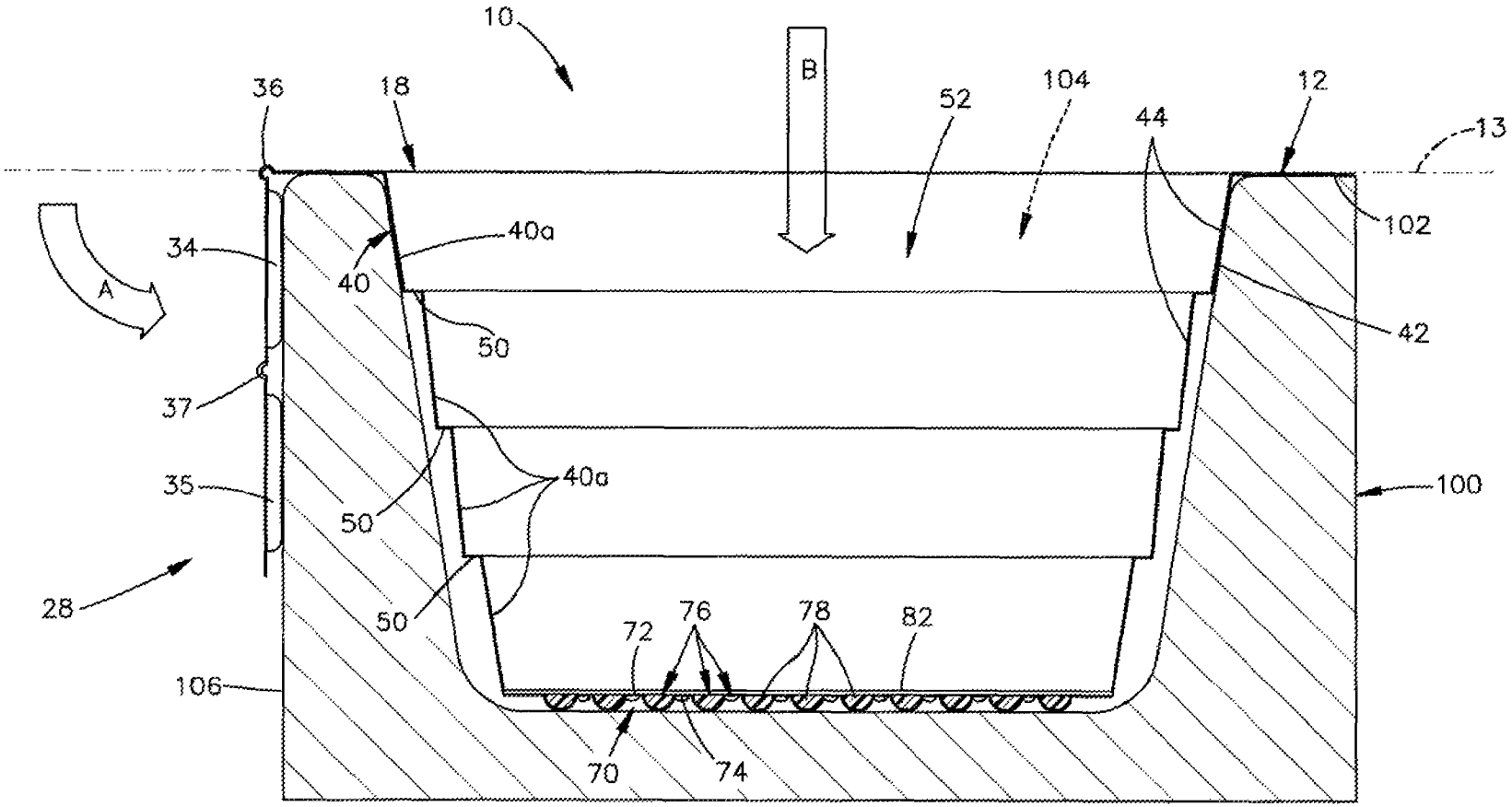
FIG. 7 is a schematic illustration of the cover of FIG. 1 in a fully expanded condition inside a bathtub.

FIG. 7 illustrates the cover 10 in the fully expanded condition. When the bottom panel 70 overlies the bottom surface 108 of the bathtub 100, the bottom panel provides protection to the bottom surface of the bathtub. In particular, the pockets 76 and the liner 82 provide a barrier between the bottom surface 108 and the surrounding environment, e.g., objects within the interior space 52 and impacts to the bottom panel 70. The barrier may prevent the bottom surface 108 of the bathtub 100 from being damaged by, for example, debris, tools or the construction workers standing on or impacting the bottom panel 70. The pockets 76 and/or the liner 82 may be tailored to provide desired protection characteristics depending on the work environment.

Figure 6:
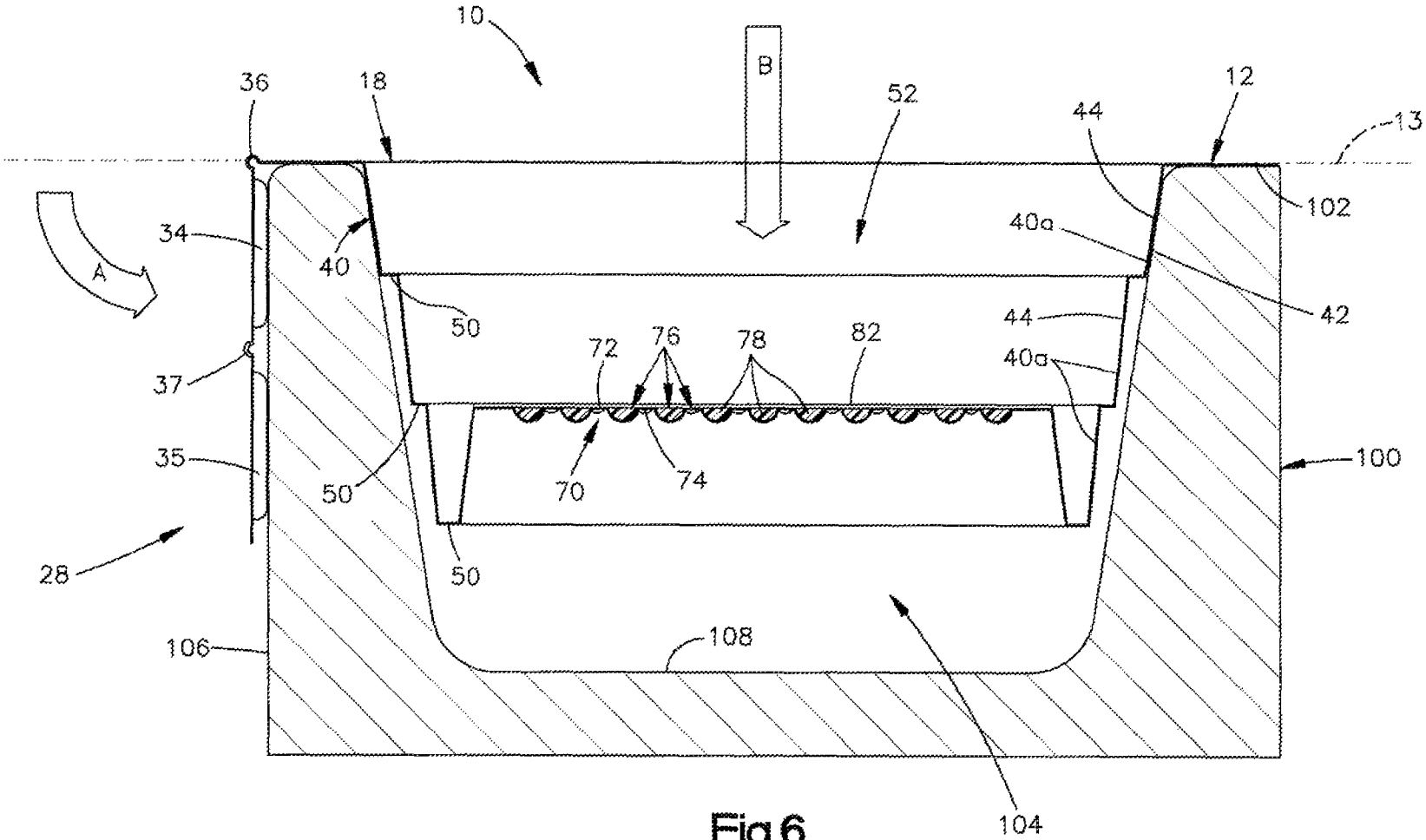
FIG. 6 is a schematic illustration of the cover of FIG. 1 in a partially expanded condition.

Before or after the wall 40 reaches the fully expanded condition, the flange 28 is folded downwards about the line of weakness 37 as indicated by arrow A in FIG. 6 to place the flange in an overlying fashion with a side 106 of the bathtub 100. The flange 28 may help mitigate or prevent the side 106 of the bathtub 100 from scratches or minor impacts. In this configuration, the ribs 34 and 35 on the flange 28 provide additional protection to the side 106 of the bathtub 100. In particular, the ribs 34 and 35 may protect the side 106 of the bathtub 100 from more forceful impacts.

From the above description of the invention, those skilled in the art will perceive improvements, changes and modifications. Such improvements, changes and modifications within the skill of the art are intended to be covered by the appended claims.

Having described the invention, the following is claimed:

1. A cover for protecting a bathtub comprising:

a base;

a wall extending from the base and defining an interior space, the wall including a plurality of concentric wall segments integrally formed with one another in an end-to-end manner and configured to be nested within one another; and a panel connected to the wall and closing an end of the interior space, the panel being adapted to engage the bathtub and having a plurality of enclosed pockets that extend away from a bottom surface of the panel for protecting the bathtub.

2. The cover recited in claim 1 wherein the plurality of pockets is filled with a force absorbing material.

3. The cover recited in claim 2 wherein the force absorbing material includes at least one of air and foam.

4. The cover recited in claim 1 wherein at least one of the plurality of pockets has a first size and at least one of the plurality of pockets has a second, different size.

5. The cover recited in claim 1 wherein the plurality of pockets extends away from the interior space.

6. The cover recited in claim 1 wherein the wall includes a plurality of wall segments separated by lines of weakness, the wall segments having a first condition in which the wall segments are nested and a second condition in which at least one of the wall segments is not nested.

7. The cover recited in claim 6 wherein the panel extends substantially along a plane of the base when the wall segments are in the first condition, the panel being spaced from the plane of the base when the wall segments are in the second condition.

8. The cover recited in claim 1 further comprising a liner overlying the panel and sealing the plurality of pockets.

9. A cover for protecting a bathtub comprising:

a base having a flange with a plurality of ribs and being movable relative to the base along a line of weakness formed in the base;

a wall extending from the base and defining an interior space; and a panel connected to the wall and closing an end of the interior space, the panel being adapted to engage the bathtub and having a plurality of pockets for protecting the bathtub.

10. The cover recited in claim 9 wherein the flange includes a line of weakness that separates a first plurality of ribs and a second plurality of ribs on the flange.

11. A cover for protecting a bathtub comprising:

a base extending along a plane;

a flange having a plurality of ribs, the flange being movable relative to the base;

a wall connected to the base and defining an interior space, the wall including a plurality of expandable wall segments capable of nesting within one another; and a panel connected to the wall and closing an end of the interior space, the panel being adapted to protect the bathtub and having a first position in which the panel extends substantially along the plane when the wall segments are nested and a second position in which the panel is spaced from the plane when at least one of the wall segments is not nested.

12. The cover recited in claim 11 wherein the panel includes a plurality of pockets filled with a force absorbing material and adapted to protect the bathtub.

13. The cover recited in claim 12 further comprising a liner overlying the panel and sealing the pockets.

14. The cover recited in claim 12 wherein the force absorbing material includes at least one of air and foam.

15. The cover recited in claim 12 wherein at least one of the plurality of pockets has a first size and at least one of the plurality of pockets has a second, different size.

16. The cover recited in claim 12 wherein the plurality of pockets extends away from the interior space.

17. The cover recited in claim 11 wherein the plurality of wall segments is separated by lines of weakness for nesting the wall segments.

18. The cover recited in claim 11 wherein when the panel is in the second position none of the wall segments is nested.

* * * * *